United States Patent [19]

Schmidt

[11] Patent Number: 4,931,035

[45] Date of Patent: Jun. 5, 1990

[54] MAILER WITH OVERSIZED INSERT AND METHOD OF MAKING

[75] Inventor: Eric Schmidt, Elgin, Ill.

[73] Assignee: Wallace Computer Services, Inc., Hillside, Ill.

[21] Appl. No.: 244,727

[22] Filed: Sep. 15, 1988

[51] Int. Cl.[5] ..... B31B 1/10; B31B 1/14; B31B 1/62

[52] U.S. Cl. ..... 493/216; 493/224; 493/231; 493/235; 493/249; 493/381; 493/347; 229/69

[58] Field of Search ..... 493/216, 223, 224, 231, 493/235, 249, 266, 381, 346, 362, 917, 221; 229/69

[56] References Cited

U.S. PATENT DOCUMENTS

| | | | |
|---|---|---|---|
| 4,063,398 | 12/1977 | Huffman | 53/461 |
| 4,067,171 | 1/1978 | Herbert et al. | 493/216 |
| 4,081,127 | 3/1978 | Steidinger | 229/69 |
| 4,095,695 | 6/1978 | Steidinger | 229/69 |
| 4,264,317 | 4/1981 | Feldkamper | 493/235 |

*Primary Examiner*—Frederick R. Schmidt
*Assistant Examiner*—Jack Lavinder
*Attorney, Agent, or Firm*—Tilton, Fallon, Lungmus & Chestnut

[57] ABSTRACT

A mailer having an oversized insert and method wherein an interior ply is transversely folded and adhered to an unfolded interior ply.

4 Claims, 1 Drawing Sheet

FIG. 1
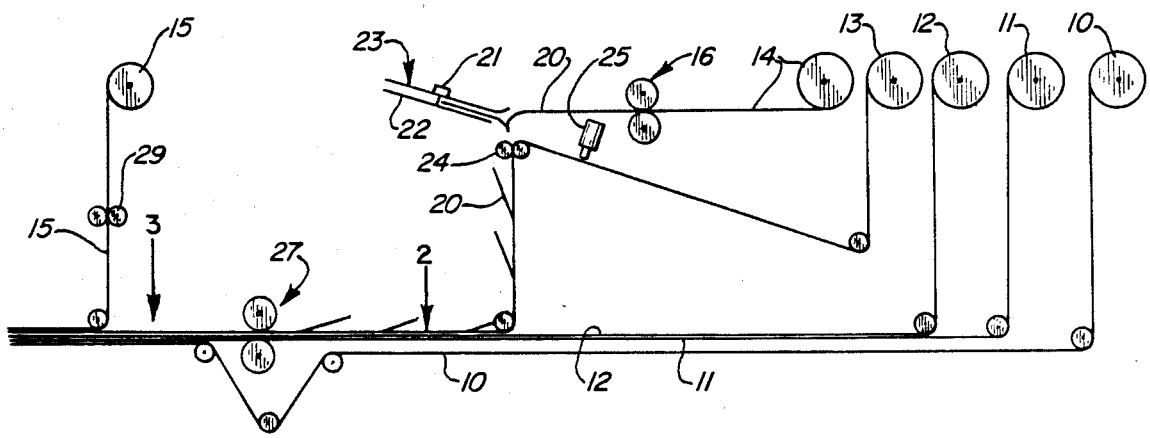
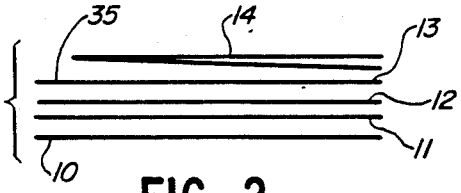
FIG. 2
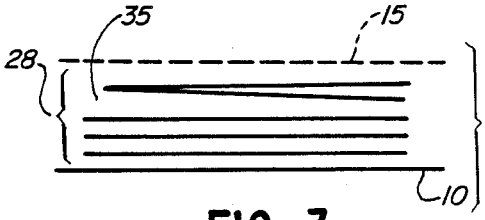
FIG. 3
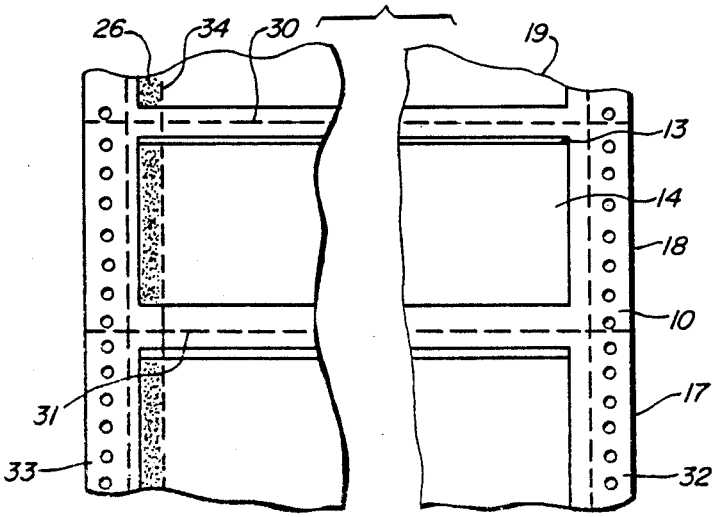
FIG. 4

MAILER WITH OVERSIZED INSERT AND METHOD OF MAKING

BACKGROUND AND SUMMARY OF INVENTION

This invention relates to a mailer having an oversized insert and method of making the same and, more particularly, to a connected series of stuffed, sealed envelope assemblies.

Heretofore, manufacturers of business forms have provided mailers with oversized return envelopes. However, no one had provided a transversely folded, oversized insert ply. Typically, however, the insert plies are smaller than the outer dimensions of the envelope—as is the return envelope. A typical return envelope for a mailer is seen in co-owned Patent No. 4,081,127.

The inventive mailer is made by transversely folding a discrete ply and thereafter adhering it to a continuous web ultimately constituting the adjacent insert ply. This adjacent insert ply is transversely severed and thereafter adhesively secured to one of the outer plies of the envelope. Lines of longitudinally extending perforation are provided adjacent the glued edge of the insert plies which provides a removable stub so as to open the envelope while freeing the insert plies so that the same can be removed by the recipient.

The invention is described in conjunction with the accompanying drawing in which FIG. 1 is a schematic elevational view of apparatus employed in the practice of the invention;

FIG. 2 is a schematic side elevational view of a portion of the webs in FIG. 1 as seen at the position designated 2;

FIG. 3 is a view similar to FIG. 2 but showing the condition of the webs at position 3 of FIG. 1; and FIG. 4 is a top plan view of the webs as they would appear in position 3 of FIG. 1 or, alternatively, from the top of FIG. 3.

DETAILED DESCRIPTION

In the illustration given, the numerals 10–15 designate a series of parent rolls which are disposed along the length of the machine frame (not shown). The parent roll 10 provides a web or ply which ultimately becomes the bottom ply of the mailer, i.e., the stuffed envelope assembly—see FIGS. 2–4. The parent rolls 11–13 provide insert plies as designated in FIG. 2 while the parent roll 14 provides a folded or oversized ply, similarly designated in FIG. 2. Lastly, the parent roll 15 provides the top or other exterior ply of the envelope assembly and is seen in dashed line at the top of FIG. 3.

In the practice of the invention, the web from the parent roll 14 is unwound and transversely severed by knife and anvil rolls generally designated 16. Here, it will be appreciated that the term "transverse" refers to the across machine direction whereas "longitudinal" refers to the direction in which the webs travel in the machine. This is to avoid any confusion because the envelope assemblies as seen in FIG. 4 as at 17, 18 and 19 have their long dimensions extending transversely of the machine. Therefore, when the terms "transverse" and "longitudinal" are used herein, they refer to the web in the machine and not the individual envelope assemblies.

The severed segment from the web roll 14 is seen in the central upper portion of FIG. 1 and is designated 20.

It is seen in the process of being transversely folded by having its forward or leading edge butted against a stop 21 of the chute 22 of the buckle folder generally designated 23. Such equipment is conventional. Thereafter, the folded portion of the segment 20 enters between nip rolls 24 at which time it is adhesively united to the continuous web being unwound from the parent roll 13. Advantageously, prior to uniting the web segment 20 with the web from the parent roll 13, the latter is equipped with a longitudinally extending line of adhesive by means of the applicator 25. The adhesive is depicted schematically in FIG. 4 as at 26.

The now folded insert plies 20 are seen attached to the web 13 and are joined with the webs 12 and 11 issuing from the similarly designated parent rolls. These three webs with the web 13 being equipped with the folded segments 20 enter another cutoff roll arrangement generally designated 27 which removes a chip from all of these webs. The condition of the webs prior to entering the cutoff means 27 is seen in FIG. 2 while thereafter, the condition is seen in FIG. 3. After the chips have been removed from the webs 11, 12 and 13, the assembly designated 28 in FIG. 3 is applied to the bottom web 10 which has been detoured around the cutting means 27.

Finally, the web 15 ultimately constituting the top web of the envelope assembly is superposed on the other five plies or webs. Incident to that, a pattern of adhesive is advantageously applied to the web 15 by the adhesive unit 29. This provides a perimeter of glue around and outside of the insert plies but which secures the top and bottom plies 10, 15 together in conventional fashion. The rectangular pattern of adhesive has been omitted from the showing in FIG. 4 for ease of understanding.

Normally, downstream of the superposition of the top ply 15 on the underlying plies, the continuous web assemblies are transversely perforated as at 30, 31 to define adjacent envelope assemblies. Conventionally, these are zig-zag folded and fed incrementally into a computer printer where the variable information is applied thereto. The operation of the manufacturing machinery and also the computer printer are facilitated by the usual control punch margins 32, 33.

A line of perforation in the final assembly at 34 is provided adjacent one longitudinal edge of the insert plies so as to provide a stub removable so as to open the envelope. This line of perforation may be provided most advantageously at the press—the operation preceding the development of the parent rolls 10–15. Normally, the webs are processed through printing presses to put down the format of the mailer into which the variable information is introduced. However, it is also possible to provide the longitudinally extending line of perforation 34 downstream of the superposition of the top ply 15. Removal of one edge of the envelope assembly 18, for example, not only opens the envelope but also removes the stub which has secured the folded oversized ply 14 to the adjacent ply 13.

SUMMARY OF OPERATION

FIG. 1 shows the insert web 14 which is derived from the similarly numbered parent roll being cut off by the cutoff means 16 consisting of knife and anvil rolls. This develops a segment 20 which is then transported to the buckle folder 23 until it reaches the stop 21. The segment 20 then buckles which may be along a line of weakening or perforation, and is directed through the nip rolls 24 where it is joined with the web 13.

Prior to the segment 20 being joined thereto, the web 13 has had a line of adhesive 26 applied by the glue nozzle 25. This line of adhesive holds the cut sheet insert 20 in position as the assembly proceeds through the subsequent collating operations.

It will be appreciated that if the oversized insert ply is desirably larger—to approximate a conventional letter, an additional chute 22 may be installed so as to double fold the segment 20.

In that event, there would be overlaps at both transversely folded edges—the overlap with the single fold being seen at 35 in FIGS. 2 and 3. This overlap is necessary to avoid slicing off the folded portion of the folded ply 14 incident to the removal of the transversely elongated chip.

While in the foregoing specification a detailed description of an embodiment of the invention has been set down for the purpose of illustration, many variations may be made in the details given without departing from the spirit and scope of the invention.

I claim:

1. A method of mailer manufacture comprising the steps of:

advancing a first web along a longitudinally extending path toward a uniting station, advancing a second web toward said uniting station and transversely severing the same to provide a series of folded insert plies, adhesively applying a series of folded insert plies at said uniting station to said first web in longitudinally spaced relation to provide a 3 ply assembly with the fold thereof extending transversely of said path, severing said first web between each pair of adjacent folded insert plies, and adhesively securing said assembly between two continuous outer plies which are thereafter adhesively attached to one another, said step of applying said series of folded insert plies including adhering each folded insert ply to said first web along a longitudinally extending line adjacent one edge of each folded insert ply, each ply of said assembly being equipped with longitudinally extending line of perforation adjacent to but spaced inwardly of said line of adhesive.

2. The method of claim 1 in which said severing step includes the removal of a transversely elongated chip of ply material having an edge adjacent to but spaced from the fold of each folded insert ply.

3. A method of manufacturing a mailer having an oversized insert comprising the steps of advancing a first web along a longitudinally extending path toward a uniting station, adhesively applying at said uniting station a series of insert plies having at least one transverse fold to said first web in longitudinally spaced relation to provide a three ply assembly, with each folded insert ply being adhered to said first web along a longitudinally extending line adjacent one edge of each folded insert ply, severing said first web between each pair of insert plies, and adhesively securing said assembly between two continuous outer plies which are thereafter adhesively attached to one another, each ply being equipped with a longitudinally extending line of perforation adjacent to but spaced inwardly of said line of adhesive.

4. The method of claim 3 in which said series of folded insert plies are derived from a second insert ply advanced along a longitudinally extending path toward said uniting station, said second insert ply in said second longitudinally extending path being transversely severed and transversely folded prior to being adhesively applied to said first insert ply.

* * * * *